United States Patent [19]

Vermeulen et al.

[11] Patent Number: 4,762,759

[45] Date of Patent: Aug. 9, 1988

[54] IMAGE-RECEIVING MATERIAL WITH SILOXANE, COLLOIDAL SILICA AND GELATIN FOR SILVER COMPLEX DIFFUSION TRANSFER

[75] Inventors: Leon L. Vermeulen, Herenthout; Ludovicus H. Vervloet, Kessel; Willy P. De Smedt, Mechelen; Piet Kok, Gent, all of Belgium

[73] Assignee: AGFA-Gevaert N.V., Mortsel, Belgium

[21] Appl. No.: 928,102

[22] Filed: Nov. 7, 1986

[30] Foreign Application Priority Data

Nov. 15, 1985 [EP] European Pat. Off. ..... 85201879.5

[51] Int. Cl.[4] ..... G03C 5/54; G03C 1/30

[52] U.S. Cl. ..... 430/1; 430/14; 430/231; 430/232; 430/621

[58] Field of Search ..... 430/231, 232, 621, 1, 430/10, 14

[56] References Cited

U.S. PATENT DOCUMENTS 2,698,237 12/1954 Land ..... 430/231

2,878,121 3/1959 Gray ..... 430/231

4,429,032 1/1984 Matthe et al. ..... 430/231

*Primary Examiner*—Richard L. Schilling

*Attorney, Agent, or Firm*—William J. Daniel

[57] ABSTRACT

An image-receiving material adapted for silver complex diffusion transfer processing and for forming a laminate, e.g. serving as an identification document, wherein said material comprises a hydrophobic resin support or resin-coated paper support directly coated on a resin surface thereof with a DTR-image receiving layer containing developing nuclei in a binder medium and comprising in percent by weight on its total weight the following ingredients:

2% to 45% of gelatin,

25% to 85% of colloidal silica, 1.0% to 50% of a copolymer consisting of copolymerized ethylene and an alpha,beta-unsaturated carboxylic acid monomer in free acid or salt form, wherein the polymerized ethylene content is not lower than 80% by weight, and 0.2% to 35% of a siloxane forming a reaction product through its siloxane group with the colloidal silica, the dry coverage of the image-receiving layer being in the range of 1 g to 15 g per m2.

16 Claims, No Drawings

IMAGE-RECEIVING MATERIAL WITH SILOXANE, COLLOIDAL SILICA AND GELATIN FOR SILVER COMPLEX DIFFUSION TRANSFER

DESCRIPTION

The present invention relates to an image-receiving material suitable for carrying out the silver complex diffusion transfer reversal (DTR) process and to laminar articles comprising a DTR image.

The principles of silver complex diffusion transfer reversal imaging are known e.g. from the book: "Photographic Silver Halide Diffusion Processes" by André Rott and Edith Weyde—Focal Press—London—New York (1972).

DTR-procesing being by nature a wet processing yields prints that are still damp after the exposed and developed photographic silver halide material has been separated from the image-receiving material containing developing nuclei in a hydrophilic binder. Known binding agents for a DTR-image-receiving material are polymeric hydrophilic substances swelling in water such as gelatin used alone or in combination with alginic acid derivatives, polyvinyl alcohol, starch and starch derivatives, particularly carboxymethylcellulose or gallactamannans (ref. the above mentioned book of André Rott and Edith Weyde, p. 49). Other organic binding agents of the synthetic type are e.g. poly-N-vinylpyrrolidinone, copolymers of polyvinyl ester and maleic anhydride. As inorganic binding agent colloidal silica has been mentioned, e.g. in U.S. Pat. No. 2,698,237.

The swelling properties of the image-receiving layer largely influence the speed of the DTR-image formation and image quality. In fact, if the layer swells too slowly, the entire DTR-process is retarded. In that case, the silver is deposited from too small an amount of complexed silver halide and the density is too low resulting often in brown images. On the other hand, the image-receiving layer should not swell too strongly since image-sharpness will then be less and diffusion transfer and drying times too long. Moreover, if swelling is too large, too much processing liquid is left in the processed image-receiving material so that the white regions on storage turn yellow or brown and the black image parts degrade and turn brown by transformation of image silver into silver sulphide.

As is generally known the addition of hardening agents decreases the swelling power of gelatin but normally this is accompanied by too strong a reduction in diffusion speed for the silver complexes whereby image quality in short processing times is affected.

Another problem arises when the image receiving layer has to be applied not to paper but on an hydrophobic resin surface whereto it has to adhere sufficiently in dry as well as in wet state.

Resin film base materials for use in silver halide photographic materials or silver complex DTR-receptor materials are inherently hydrophobic, whereas the usual gelatino-silver halide emulsion layers or colloid layers containing developing nuclei are highly hydrophilic. It is difficult to secure adequate anchorage between the hydrophobic film base and a waterpermeable hydrophilic image-receiving layer, especially because the anchorage must remain secure in the liquid processing step to which the material is subjected.

As described in published EP-A 0 065 329 and corresponding U.S. Pat. No. 4,429,032 a proper anchorage of a DTR-image receiving layer to a corona-discharge treated polyvinyl chloride support has been obtained by the use in the image-receiving layer of colloidal silica in a weight ratio of from 5/1 to 2/1 with respect to a hydrophilic binder such as gelatin. Although such an image-receiving layer shows the desired adherence, its cohesion and resistance to scratching are relatively poor.

The use of siloxane compounds in non-waterpermeable non-sticking subbing layers for polyester supports is described in U.S. Pat. No. 4,048,357 and the use of gelatin hardening siloxane compounds in photographic silver halide emulsion layers is described in DDR-P 155 022.

It is an object of the present invention to provide an improved DTR-image receiving material having low swelling power and yet good image-forming qualities and capable of yielding practically touch-dry copies immediately after separation from the developed photographic material.

It is a further object of the present invention to incorporate the processed DTR-image-receiving material in a laminated article serving as identification document being protected against forgery by strong adherence of the different layers and through a crosslinking reaction inside the image-receiving layer.

Other objects and advantages of the present invention will appear from the following description.

SUMMARY OF THE INVENTION

In accordance with the present invention an image-receiving material suited for silver complex DTR processing is provided which material comprises a hydrophobic resin support or resin-coated paper support directly coated on a resin surface thereof with a DTR-image receiving layer containing developing nuclei in a binder medium and comprising in percent by weight on its total weight the following ingredients:

2% to 45% of gelatin,

25% to 85% of colloidal silica having preferably an average particle size in the range of 5 to 1,000 nm, 1.0% to 50% of a copolymer consisting of copolymerized ethylene and an alpha,beta-unsaturated carboxylic acid monomer in free acid or salt form, e.g. acrylic acid, methacrylic acid, crotonic acid or itaconic acid, wherein the polymerized ethylene content is not lower than 80% by weight, preferably in the range of 85 to 95% by weight, and 0.2% to 35% of a siloxane having reacted through the siloxane part with the colloidal silica, the dry coverage of the image receiving layer being in the range of 1 g to 15 g per m2.

DETAILED DESCRIPTION OF THE INVENTION

A preferred resin support in the image receiving material according to the present invention for use in the production of laminates by heat sealing is a vinyl chloride polymer support.

The term "vinyl chloride polymer" includes the homopolymer, as well as any copolymer containing at least 50% by weight of vinyl chloride units and including no hydrophilic recurring units.

Vinyl chloride copolymers serving as the support may contain one or more of the following comonomers: vinylidene chloride, vinyl acetate, acrylonitrile, styrene, butadiene, chloroprene, dichlorobutadiene, vinyl fluoride, vinylidene fluoride, trifluorochloroethylene, and tetrafluoroethylene.

The vinyl chloride polymer serving as the support may be chlorinated to contain 60–65% by weight of chlorine.

Many properties of polyvinyl chloride and its copolymers are improved by plasticization and their stability can be improved by stabilizers well known to those skilled in the art (see, e.g., F. W. Billmeyer, Textbook of Polymer Chemistry, Interscience Publishers, Inc., New York (1957) p. 311–315)).

The vinyl chloride polymer support may contain pigments or dyes as colouring matter e.g. in an amount up to 5% by weight. An opaque white appearance may be obtained by incorporation of white pigments, e.g. titanium dioxide particles.

The vinyl chloride polymer support may be provided with an adhesive coating at the side opposite to the DTR-image-receiving layer. The adhesive coating, which may be of the pressure-adhesive type, may be protected by a strippable temporary support on the basis of siliconized glassine paper as described in Research Disclosure, March 1977, item 15513.

Colloidal silica suited for use in an image-receiving material according to the present invention is preferably hydrated silica used as a dispersion having a pH in the range of 8 to 9. The colloidal silica particles used in the present invention have preferably an average grain diameter between 10 and 100 nm. Such silica particles are available in aqueous colloidal dispersions marketed under the commercial names "LUDOX" (trade name of E. I. du Pont de Nemours, Wilmington, Del. U.S.A., and "SYTON" (trade name of Monsanto Chemical Corporation, Boston, Mass. USA and "KIESELSOLE" (trade name of Farbenfabriken Bayer AG, Leverkusen, West-Germany. SYTON X-30 is a trade name of Monsanto Chemical Company, St. Louis, Mo., U.S.A. for a 30% by weight aqueous dispersion of silica particles having an average size of 25 nm) and KIESELSOL 300-F (trade name of Farbenfabriken Bayer AG, Leverkusen, West-Germany) comprising a colloidal silica having an average particle size of 7–8 nm.

The copolymer of ethylene and the alpha,beta-unsaturated acid can be prepared by graft-copolymerization or copolymerization under pressure in aqueous medium containing the monomers, whereby the copolymer is obtained as a latex. A particularly useful copolymer is copoly(ethylene/acrylic acid) (90/10 by weight) applied in latex form with a 30 to 40% content of solids and wherein the copolymer particles having an average particle size of 20 nm are present in ammoniacal medium (pH: 8.3). The softening temperature of the latter copolymer is preferably in the range of 30° to 45° C. and the glass transition temperature is preferably in the range of of 42° to 75° C.

Representative of siloxane compounds for use in the image-receiving material according to the present invention are within the scope of the following general formula:

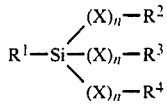

wherein:

$R^1$ represents a chemical group capable of a polymerization reaction or reactive with respect to amino and/or hydroxyl groups, e.g. of gelatin, more particularly is a group containing reactive halogen such as a reactive chlorine atom, an epoxy group or an alpha,-beta-ethylenically unsaturated group, examples of such groups being e.g. the following:

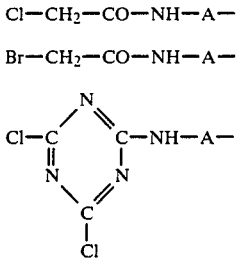

wherein A represents an alkylene group preferably a $C_1$–$C_4$ alkylene group, and

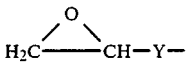

wherein

Y is a bivalent hydrocarbon chain including such chain interrupted by oxygen, e.g. is a $—CH_2—O(CH_2)_3—$ group, or a bivalent hydrocarbon group that is linked at the side of the silicon atom to oxygen, e.g. is a $—CH_2—O—$ group, X represents oxygen, each of $R^2$, $R^3$ and $R^4$ (same or different) represents a hydrocarbon group including a substituted hydrocarbon group e.g. methyl and ethyl, and n is zero or 1.

Siloxane compounds according to the above general formula are described in U.S. Pat. No. 3,661,584 and GB-P 1,286,467 as compounds improving the adherence of proteinaceous colloid compositions to glass.

Examples of particularly useful siloxane compounds are listed in the following table 1.

TABLE 1

1. 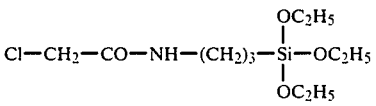

TABLE 1-continued

2.

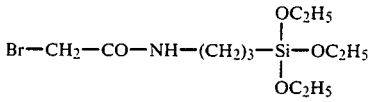

3.

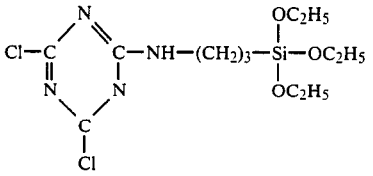

4.

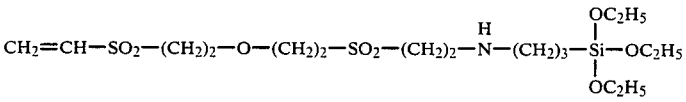

5.

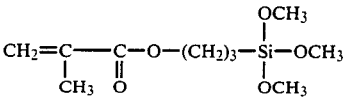

6.

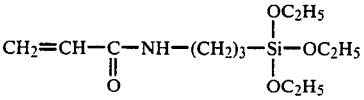

7.

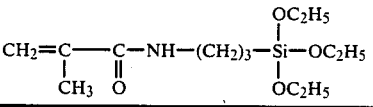

The reaction the siloxane group with the colloidal silica proceeds very rapidly in aqueous medium through a hydrolysis and dehydration reaction, which actually is a condensation reaction with hydrated silica being $Si(OH)_4$. The $R^1$ group in the siloxane compound is at room temperature (20° C.) preferably not strongly reactive with respect to gelatin so that the coating solution does not obtain a prohibitively high viscosity in the coating stage. Full hardening by crosslinking is preferably carried out at elevated temperature after the image formation, e.g. by heating during a heat-sealing lamination step.

By the siloxane group a macrosiloxane is formed with the colloidal hydrated silica according to the following reaction scheme:

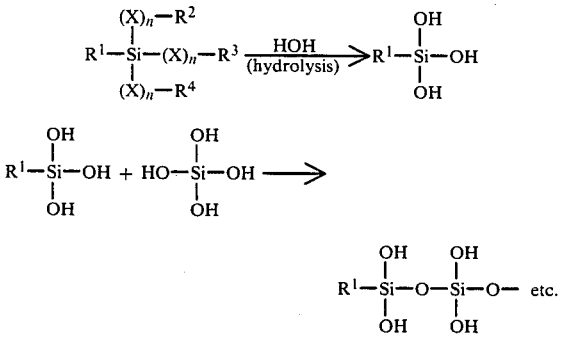

The image-receiving layer composed according to the present invention has a high resistance to abrasion and yields very rapidly a touch dry print by DTR-image formation.

It has been established experimentally that the adherence of the present image-receiving layer to a polyvinyl chloride resin support is so strong that a preliminary corona-discharge treatment may be omitted.

However, to reduce repellence on coating and improving coating speed the resin support or resin coated paper support is pre-treated with a corona discharge by passing the support, e.g. in sheet or belt form, between a grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an an AC corona unit a frequency range from 10 to 100 kHz is particularly useful. The corona treatment can be carried out with material in the form of a belt or band at a speed of 10 to 30 m per min while operating the corona unit with a current in the range of 0.4 to 0.6 A over a belt or band width of 25 cm.

The corona-discharge treatment makes it possible to dispense with a solvent treatment for attacking and roughening the surface of the resin support and is less expensive and more refined in its application.

The development nuclei used in a hydrophilic colloid binder in the silver compex DTR-image-receiving material are of the kind generally known in the art, e.g. are those described in the already mentioned book of André Rott and Edith Weyde, pages 54–56. Particularly suited are colloidal silver and colloidal metal sulphides, e.g. of silver and nickel and mixed sulphides thereof. The image-receiving material may include in the hydrophilic colloid binder any other additive known for use in such materials, e.g. toning agents, a certain amount of silver halide solvent, one or more developing agents, opacifying agents, e.g. pigments, and optical brightening agents.

The image-receiving layer can form part of a separate image-receiving material or form an integral combination with the light-sensitive layer(s) of the photographic material.

When the image-receiving layer is applied to a common support and remains associated with the silver halide emulsion layer(s) after processing of the photosensitive material, an alkali-permeable light-shielding layer, e.g. containing white pigment particles, is applied between the image-receiving layer and the silver halide emulsion layer(s) to mask the negative image with respect to the positive image as described e.g. in the already mentioned book of André Rott and Edith Weyde, page 141.

The present image-receiving layer is particularly suited for application in the production of laminar articles comprising a photograph. Thus, it is applied advantageously in the manufacture of a laminar article serving as identification document, also called I.D. card, that contains a black-and-white photograph produced by the silver complex DTR-process and by lamination is sandwiched between a clear protective resin cover sheet and the hereinbefore described hydrophobic resin-support or resin coated paper support.

In view of the widespread use of I.D. cards as security document, e.g. to establish a person's authorization to conduct certain activities (e.g. driver's licence) or to have access to certain areas or to engage in particular commerical actions, it is important that forgery of the I.D. card by alteration of certain of its data and/or photograph is made impossible.

In the laminar article according to the present invention the above defined image-receiving layer containing an image produced by DTR-processing is preferably laminated to a transparent hydrophic resin cover sheet by a technique known as heat-sealing. The hydrophobic resin cover sheet may be made of the same polymer as used for the support of the image-receiving layer but is preferably a resin sheet coated with or consisting of a resin having a lower glass transition temperature (Tg) and melting temperature (Tm) than the resin present in the support sheet. According to a preferred embodiment the cover sheet is a polyethylene terephthalate resin sheet coated with a resinous melt-adhesive layer, e.g. a polyalkylene layer, preferably polyethylene layer, having a glass transition temperature at least 40° C. lower than the glass transition temperature of the resin of the support sheet of the laminar article. In this connection reference is made to the Tg values of polyethylene, polypropylene, polyvinyl chloride and polyethylene terephthalate being −20° C., +5° C., +80° C. and +67° C. respectively (see J. Chem. Educ., Vol. 61, No. 8. August 1984, p. 668).

The lamination of the present image receiving material with a covering hydrophobic resin film sheet material proceeds preferably by heat-sealing between flat steel plates under a pressure of, e.g., 10 to 15 kg/cm2 at a temperature in the range of 120° to 150° C., e.g. at 135° C., or by using other apparatus available on the market for heat-sealing lamination purposes.

The laminate may contain the image receiving layer over the whole area of the support or in a part thereof, e.g. leaving free the edge areas as described in U.S. Pat. No. 4,101,701 and U.S. Pat. No. 4,425,421.

According to an embodiment the image-receiving layer is coated onto an opaque polyvinyl chloride support having a thickness of only 0.150 to 0.75 mm. A sheet of that thickness can still be manipulated easily in a mechanical printing process, e.g. offset or intaglio printing, and before or after being coated with the image-receiving layer can receive, additional security marks in the form of e.g. a watermark, finger prints, printed patterns known from bank notes, coded information, e.g. binary code information, signature or other printed personal data that may be applied with visibly legible or ultraviolet-legible printing inks as described e.g. in GB-P 1,518,946 and U.S. Pat. No. 4,105,333.

Other possibilities to increase security against counterfeiting are the inclusion in the laminate of infrared-absorbing markings, magnetic dots or strips and electronic microcircuits hidden from visibility, and holograms as described, e.g., in DE-OS 2 639 952, GB-P 1,502,460 and 1,572,442 and U.S. Pat. No. 3,668,795. The holographic patterns may be obtained in silver halide emulsion layers, normally Lippmann emulsions, especially designed for that purpose and can either or not be combined with a photograph.

According to an embodiment the silver halide emulsion layer for producing the hologram is applied to one side of the transparent cover sheet used in the manufacture of a laminate according to the present invention and laminated together with the image receiving layer either or not separated therefrom by a transparent resin intersheet made of polyethylene or a resin sheet such as a polyvinyl chloride sheet coated with polyethylene.

When the resin sheet used as support of the laminate has to possess a thickness as required for an identification card to be inserted in a slot of an electronic identification apparatus, several sheets of matted polyvinyl chloride are stacked and laminated so as to reach a final thickness of e.g. 0.075 to 1 mm. The laminar article contains in that case preferably in the polyvinyl chloride support sheet, opacifying titanium dioxide and a suitable plasticizing agent. The support may be provided with an embossed structure.

The following examples illustrate the present invention without, however, limiting it thereto.

All parts, ratios and percentages are by weight unless otherwise stated.

EXAMPLE 1

An opaque polyvinyl chloride sheet having a width of 24 cm and a thickness of 200 um was treated with an electrical discharge produced by a corona-discharge apparatus operated under the following conditions:
film-travelling speed: 20 m/min,
electrode spacing to film surface: 2 mm,
corona current: 0.55 A,
AC-voltage difference (peak value): 10 kV,
frequency: 30 kHz.

The corona-treated surface was coated with the following composition to form an image receiving layer for silver complex DTR processing:

| | |
|---|---|
| water | 800 ml |
| 6% aqueous dispersion of colloidal $Ag_2S.NiS$ nuclei | 7 ml |
| gelatin | 10 g |
| 30% aqueous dispersion of colloidal silica (average particle size 0.025 μm, pH: 8) | 250 ml |
| 5% solution of siloxane compound no. 7 in ethanol | 50 ml |

-continued

| | |
|---|---|
| 4% aqueous solution of formaldehyde | 10 ml |
| 34% aqueous ammoniacal dispersion of copoly(ethylene/acrylic acid) (90/10), having an average particle size of 20 nm and a softening temperature of 40° C. | 50 ml |
| water up to | 1243 ml |

The dried image receiving layer contained 8.8% of gelatin, 73.7% of silica, 2.2% of said siloxane, 15.1% of said copolymer expressed in percentages of the total weight Said composition was applied at a wet coverage of 26 $m^2/l$ and dried to form a layer containing 3.5 g of solids per m2.

By the common silver complex DTR-process a black-and-white silver image serving for identification purposes was produced therein.

Onto the imaged and dried image-receiving layer a polyethylene terephthalate sheet of 100 um previously being coated at one side with a polyethylene sheet of 30 um was laid and laminated with the polyethylene in contact with the image-receiving layer. Flat steel plates were used for pressing the layers together under a pressure of 10 kg/cm2 at a temperature of 135° C.

The image contained in the thus obtained laminate was protected against forgery not only by the good sealing but also by the crosslinking reaction taking place in the image-receiving layer making that layer impermeable to aqueous silver etching liquids.

EXAMPLES 2 TO 8

Example 1 was repeated with the difference, however, that in the same molar amount the siloxane compounds 1 to 6 respectively of the Table 1 were used. Analogous results were obtained.

EXAMPLE 9

Several combinations of ingredients applied in image-receiving materials containing a polyvinyl chloride support and covering sheet as described in Example 1 were tested with regard to DTR-image forming properties and capability of firm lamination. The combinations described hereinafter in Table 2 containing development nuclei as described in Example 1 and coated at a dry coverage of 3.5 g per m2 proved to offer good results.

TABLE 2

| Ingredient | Percentage with respect to dry image-receiving layer | | | | | | | | | | | |
|---|---|---|---|---|---|---|---|---|---|---|---|---|
| gelatin | 2.4 | 16 | 33 | 20 | 13 | 5 | 9 | 7 | 6 | 10 | 8 | 5 |
| silica | 79 | 68 | 54 | 36 | 63 | 85 | 75 | 62 | 52 | 85 | 64 | 46 |
| siloxane | 2.4 | 2 | 1.6 | 5 | 3 | 1 | 0.2 | 18 | 31 | 2.6 | 2 | 1.4 |
| copolymer | 16 | 14 | 11 | 39 | 21 | 9 | 15 | 13 | 11 | 1.7 | 26 | 47 |

The siloxane compound 7 of Table 1 was used and the gelatin, silica and copolymer described in Example 1 were combined therewith.

We claim:

1. An image-receiving material adapted for silver complex diffusion transfer processing, wherein said material comprises a hydrophobic resin support or resin-coated paper support directly coated on a resin surface thereof with a DTR-image receiving layer containing developing nuclei in a binder medium and comprising in percent by weight on its total weight the following:

2% to 45% of gelatin,

25% of 85% of colloidal silica, 1.0% to 50% of a copolymer consisting of copolymerized ethylene and an alpha,beta-unsaturated carboxylic acid monomer in free acid or salt form, wherein the polymerized ethylene content is not lower than 80% by weight, and 0.2% to 35% of a siloxane forming a reaction product with said colloidal silica, the dry coverage of the image-receiving layer being in the range of 1 g to 15 g per m2.

2. An image-receiving material according to claim 1, wherein the alpha,beta-unsaturated carboxylic acid monomer is acrylic acid.

3. An image-receiving material according to claim 1, wherein the copolymerized ethylene is present in the copolymer in the range of 85 to 95% by weight.

4. An image-receiving material according to claim 1, wherein the silica has an average particle size in the range of 5 to 1,000 nm.

5. An image-receiving material according to claim 1, wherein the support is made of a vinyl chloride homopolymer or copolymer, the copolymer containing at least 50% by weight of vinyl chloride units and being free from hydrophilic recurring units.

6. An image-receiving material according to claim 1, wherein the siloxane compound is within the scope of the following general formula:

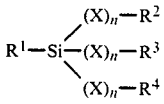

wherein:

$R^1$ represents one of the following groups:

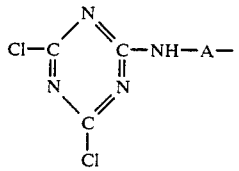

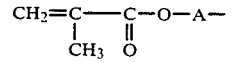

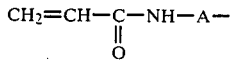

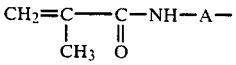

wherein A represents a $C_1$–$C_4$ alkylene group, and

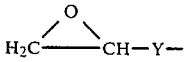

wherein

Y is bivalent hydrocarbon chain, or a bivalent chain containing hydrogen-substituted carbon atoms and at least one oxygen atom, each said oxygen atoms connecting two of said carbon atoms, or a bivalent hydrogen carbon group that is linked at the side of the silicon atom to oxygen, X represents oxygen, each of $R^2$, $R^3$ and $R^4$ (same or different) represent a hydrocarbon group, and n is 0 or 1.

7. A laminar article containing in an image-receiving layer a black-and-white photograph produced by the silver complex DTR-process which layer is sandwiched between a clear protective resin cover sheet and a hydrophobic resin-support or resin coated paper support, wherein said image-receiving layer contains developing nuclei in a binder medium and comprises in percent by weight on its total weight the following:

2% to 45% of gelatin,

25% to 85% of colloidal silica, 1.0% to 50% of a copolymer consisting of copolymerized ethylene and an alpha,beta-unsaturated carboxylic acid monomer in free acid or salt form, wherein the polymerized ethylene content is not lower than 80% by weight, and 0.2% to 35% of a siloxane forming a reaction product with said colloidal silica, the dry coverage of the image-receiving layer being in the range of 1 g to 15 g per m2.

8. A laminar article according to claim 7, wherein the alpha,beta-unsaturated carboxylic acid monomer is acrylic acid.

9. A laminar article according to claim 7, wherein the copolymerized ethylene is present in the copolymer in the range of 85 to 95% by weight.

10. A laminar article according to claim 7, wherein the silica has an average particle size in the range of 5 to 1,000 nm.

11. A laminar article according to claim 7, wherein the support is made of a vinyl chloride homopolymer or copolymer, the copolymer containing at least 50% by weight of vinyl chloride units and being free from hydrophilic recurring units.

12. A laminar article according to claim 7, wherein the siloxane compound is within the scope of the following general formula:

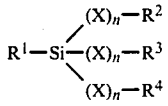

wherein:

$R^1$ represents one of the following groups:

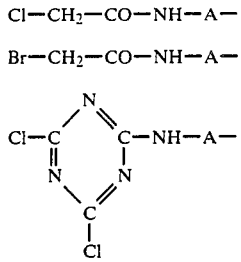

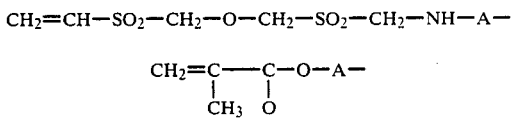

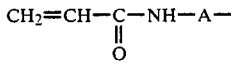

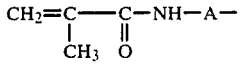

wherein A represents a $C_1$-$C_4$ alkylene group, and

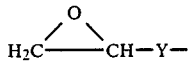

wherein

Y is a bivalent hydrocarbon chain, or a bivalent chain containing hydrogen-substituted carbon atoms and at least one oxgen atom, each said oxygen atoms connecting two of said carbon atoms, or a bivalent hydrocarbon group that is linked at the side of the silicon atom to oxygen, X represents oxygen, each of $R^2$, $R^3$ and $R^4$ (same or different) represent a hydrocarbon group, and N is 0 or 1.

13. A laminar article according to claim 7, wherein the cover sheet is a resin sheet coated with or consisting of a resin having a lower glass transition temperature (Tg) and melting temperature (Tm) than the resin of said support.

14. A laminar article according to claim 13, wherein the cover sheet is a polyethylene terephthalate sheet coated with a polyethylene layer.

15. A laminar article according to claim 7, wherein the support is provided with security marks in the form of a watermark, finger print, signature, binary code pattern or printed pattern.

16. A laminar article according to claim 7, wherein said article contains a magnetic stripe and/or hologram.

* * * * *